US007872585B2

(12) United States Patent
Scully

(10) Patent No.: US 7,872,585 B2
(45) Date of Patent: Jan. 18, 2011

(54) INTRUDER DETERRENT SYSTEM

(75) Inventor: Nick Scully, Louth (GB)

(73) Assignee: Martin Professional A/S, Aarhus N (DK)

( * ) Notice: Subject to any disclaimer, the term of this patent is extended or adjusted under 35 U.S.C. 154(b) by 352 days.

(21) Appl. No.: 12/107,845

(22) Filed: Apr. 23, 2008

(65) Prior Publication Data

US 2009/0212947 A1 Aug. 27, 2009

(30) Foreign Application Priority Data

Feb. 26, 2008 (DK) ..... 2008 00265

(51) Int. Cl.
*G08B 17/10* (2006.01)

(52) U.S. Cl. ..... 340/628; 340/541

(58) Field of Classification Search ..... 340/541, 340/545.1, 547, 506, 628; 446/467, 24; 62/168, 62/384; 239/136, 133
See application file for complete search history.

(56) References Cited

U.S. PATENT DOCUMENTS 4,871,115 A * 10/1989 Hessey ..... 239/136
5,331,822 A * 7/1994 Belliveau et al. ..... 62/168
5,394,139 A * 2/1995 Dards ..... 340/541
5,676,886 A * 10/1997 Fleming ..... 261/16
6,094,135 A * 7/2000 Sugimoto et al. ..... 340/541
7,297,045 B2 * 11/2007 Pierson et al. ..... 446/467

FOREIGN PATENT DOCUMENTS

EP 0659293 B1 6/1995
KR 20040074227 8/2004
SE 9904818 6/2001

OTHER PUBLICATIONS

Danish Office Action dated Jul. 2, 2008.

* cited by examiner

*Primary Examiner*—Van T. Trieu
(74) *Attorney, Agent, or Firm*—Roberts Mlotkowski Safran & Cole, P.C.; David S. Safran

(57) ABSTRACT

A system and a method for operating an intruder deterrent system by which a smoke screen is generated in response to an intruder being detected, a smoke screen generator operatively linked to the intruder detecting. To achieve an intruder deterrent system that can operate for a longer period after interruption in the power supply, latent heat is stored in a heat storage, and smoke can be generated by transferring the latent heat from the heat storage to a liquid, which liquid is evaporated. The use of the heat storage has led to the unexpected result that the smoke generator can operate independently of power to the heating elements for a very long period.

31 Claims, 6 Drawing Sheets

INTRUDER DETERRENT SYSTEM

BACKGROUND OF THE INVENTION

1. Field of the Invention

The present invention relates to an intruder deterrent system, which system generates a smoke screen and which system comprises intruder detection means, smoke screen generating means, activating means operatively linked to the intruder detecting means and the smoke screen generating means to activate the smoke screen generating means when the intruder detection means is triggered.

The present invention further relates to a method for operating an intruder deterrent system, which method concerns generating a smoke screen activated by intruder detection, which method concerns smoke screen generating operatively linked to the intruder detecting.

2. Description of Related Art

EP 0659293 concerns an intruder deterrent system of the type which generates a smoke screen and which comprises: intruder detection means; smoke screen generating means; activating means operatively linked to the intruder detection means and the smoke screen generating means to activate the smoke screen generating means when the intruder detection means is triggered; and smoke screen density regulating means having a smoke screen density sensor to sense the density of the smoke screen and control means responsive to the sensed density to adjust the output of the smoke screen generating means to maintain the smoke screen density at a desired level.

SUMMARY OF THE INVENTION

It is the object of the invention to achieve an intruder deterrent system that can operate for a longer period after interruption in the power supply.

A further object of the invention is to achieve an intruder deterrent system that comprises a heating storage, which allows a system to operate with a small mostly continuously power demand and able to deliver smoke at high speed and density without rapidly increase the power demand.

The object of the invention can be fulfilled by a system as described in the preamble to claim one and further modified by designing the smoke generating means to comprise a heating storage block, which heating storage block forms a heating storage, which heating storage block can comprise at least one electric heater, which heating storage block comprises at least one flow channel, which flow channel comprises a number of turns, which channel has a length that at least is longer than the longest side of the heating storage block. By using a large metal block as heat storage it is possible to store energy for evaporating a fluid so that the power demand during operation will be reduced. Using the heating storage will lead to a situation where a power failure will not be able to stop the generation of smoke. If a system comprises an uninterruptible power supply, (UPS) or connected to batteries operation will continue as long as there is a power supply and as long there is still sufficient heating stored in the heat storing means. The heating which is stored will probably last for several minutes and will probably be effective up to 40 minutes. If an intruder starts to interrupt the power supply to a building, he will not be able to disconnect the smoke generating means. The use of the heating storage block will also reduce the peak power consumption of the smoke generator. The power consumption will be more an average demand which is more ore less continues is sufficiently smaller than the power demand in previous smoke detectors which are generating steam by immediately heating the liquid.

The heating storage block can be formed of at least two sections, which two sections are fastened towards each other by fastening means. By producing the heating storage block in to sections a channel can be formed in only one of the two sections. That can lead to a situation where one of the sections comprises electrical heating and also comprises the channel at the top. The second section, which coverers the channel can then be a relative thick flat section where only the mass of the material is used for the heat storage. The two sections have to be fastened towards each other. It is possible to screw the sections together but welding seems to be the preferred method.

In a preferred embodiment for the invention the heating storage block can comprise an upper section and a lower section, which heating block further comprises a middle section, which middle section is placed between the upper section and the lower section, which upper section comprises at least one electric heating element embedded in the material, which electric heating element comprises a first terminal and a second terminal, which lower part further comprises an electrical heating element embedded in the material, which heating element comprises electrical terminals, which middle section comprises inlets, which the middle section comprises channels as well at the upper side as the lower side. Hereby can a large system be achieved.

It is preferred that the channel has at least a first inlet connected towards at least a first pump, which channel can have at least one outlet connected to a system outlet. In order to assume sufficient flow in the channel a pump is needed. This pump has two purposes. The first is to supply the channel with liquid during operation, but also during operation the pump is necessary as a kind of return valve because the pump typically is a piston pump which might comprise valves. These valves together with the operation pump will work as a return valve. If the pump presses liquid into the channel then the liquid in the channel will evaporate.

The channel can comprise a first cross-sectional area near the inlet is smaller than the cross-sectional area near the outlet. By letting the cross-sectional area increase along the channel it can be achieved that there is sufficient room for the steam that is generated. Because the evaporation of the liquid will increase the volume enormously there is needed an increasing speed of flow together with a bigger flow cross-sectional area.

In a preferred embodiment, the channel can be formed with a number of turns, which turns can be formed with a minimal radius, which turns is formed with a crisp 90 degree angle. During the heating process there will very soon be formed a mixture of liquid and gas. This mixture has to be mixed a much as possible during the flow through the channel in order to achieve good contact to the liquids so that liquid can be evaporated. One way of avoiding a laminar flow in the channel is to use turns. Forming the turns with a crisp angle of 90 degrees will lead to an effective mixture of liquid and gas.

The intruder deterrent system can comprise at least one pump, the duration of operation of the pump is controllable by said control means to regulate the density of the smoke screen. One way of controlling the density of the smoke is to control the duration of the pump. The pump could be controlled by pulse with modulation (PWM). By PWM modulation is achieve an effective regulation where the smoke is formed continues. In a smoke generator using a heating storage it is not possible to regulate the heating element. Therefore, an effective control of the pump is preferred.

The intruder deterrent system can comprise a storage tank for an aqueous liquid composition and one or more delivery pipes extending from the tank to deliver the liquid composition to the heat storage block, which heat storage block comprising heating means to heat the liquid composition in the delivery pipe to thereby convert the liquid composition into a dense vapour. In one possible embodiment for the invention there is more than one channel for evaporating the liquid. In that situation it is preferred that there are more delivery pipes from the liquid storage tank.

The aqueous liquid composition can comprise a mixture of glycol and water. One possible liquid is a mixture of glycol and water, but other mixtures of water and other chemicals would also be possible in this invention.

It is preferred that the intruder deterrent system comprise a liquid control system, which liquid control system comprises a first liquid container, which liquid control system further comprises a second liquid container, which first liquid container contains a first liquid, which first liquid is mostly water, which second container contains a second liquid, which second liquid is mostly glycol, which liquid control system comprises a first pump for pumping the first liquid, which liquid control system further comprises a second pump for pumping the second liquid. By operating two pumps independently of each other it is possible by this invention to adjust the mixture of the two liquids in dependence of the actual demand. That means in the beginning the glycol contents could be higher and then later be reduced. At least by the end of operation the whole system could be cleaned by water and all residues of glycol or other chemicals will be removed.

The intruder deterrent system can comprise at least a first density sensor. A density sensor is highly effective for regulating the smoke density in a room. The signal from the density sensor can be used for input for controlling the pumps.

The density sensor can be housed in a first housing and the smoke screen generating means can be housed in another housing independent from the said first housing. In a preferred embodiment the density sensor can be placed in some distance from the smoke generator. In a building there can be some areas which have to be protected in distance from the smoke generator and if the smoke density at the most critical places in the building are achieved, then it will be more effective to use external sensors than just sense the smoke density outside the smoke generator.

The smoke screen density sensor and the smoke screen generating means can be operatively linked by wireless communication means. One way of connecting the density sensor to the smoke generator is wireless communication, but it is to be understood that also all other forms of communication could be uses such as cables or optical communication.

It is preferred that a number of intruder deterrent system can be operatively linked by wireless communication means, wherein the heating elements are operating in time share mode depending on actual heating demand. Here by can a number of intruder deterrent systems can be connected to an electric grid without over loading this grid. The intruder deterrent systems can be interconnected so only one heating element is connected to the grid during normal maintain heating. Only few minutes power connection pr. hour can keep the intruder deterrent system ready for operation. 15-20 intruder deterrent systems can in this way operate with a power demand as small as 1.5 KW.

The intruder deterrent system can comprise at least one pump, where the rate of operation of the pump can be controllable by said control means in dependence upon the temperature of the heat storing block. During operation the heat storing block might decrease its temperature. The most effective smoke generation takes place if the pumps are controlled also dependently of the temperature of the heating block. In order to achieve that regulation, a temperature sensor might be placed in the block and signal from the temperature sensor are used as one of the inputs for controlling the pumps.

The object of the invention can be fulfilled by a method as described in the preamble to claim 15 and further modified by storage of latent heat in a heat storage block, where smoke can be generated by heat exchanging the latent heat from the heat storage block to a liquid, which liquid is evaporated. The use of the heat storage block has led to the unexpected result that the smoke generator can operate independently of power to the heating elements for a very long period. This period depends on the total mass of the block that is used. Typically, a block will be used that has sufficient heat storage for operating the smoke generator up to 40 minutes after a power failure. This can lead to a situation where if intruders before entering a building disconnect power supply or interrupt the power supply, the building will be protected if only the pumps are operated by batteries or uninterruptible power supply (UPS). The heat storage also use the benefit that the heating element as such has a smaller power demand than en previous smoke generators. The average power consumption is probably the same, but there are no peak consumptions in operation.

This patent application further concerns an entertainment system, which system generates a smoke screen and which system comprises smoke screen generating means; activating means operatively linked to the an entertainment controller and where the smoke screen generating means activate the smoke screen generating means when the entertainment controller is transmitting a smoke command, where the smoke generating means comprises a heating storage, which heating storage forms a heating storage, which heating storage comprises at least one first electric heater, which heating storage block comprises at least one flow channel, which flow channel comprises a number of turns, which channel has a length that at least is longer than the longest side of the heating storage. Herby is achieved that a system as described in this patent application also can be used for entertainment. A highly effective smoke screen can by this invention be generated at a stage over a long period of time with a low power consumption.

DETAILED DESCRIPTION OF THE INVENTION

Figure 1:
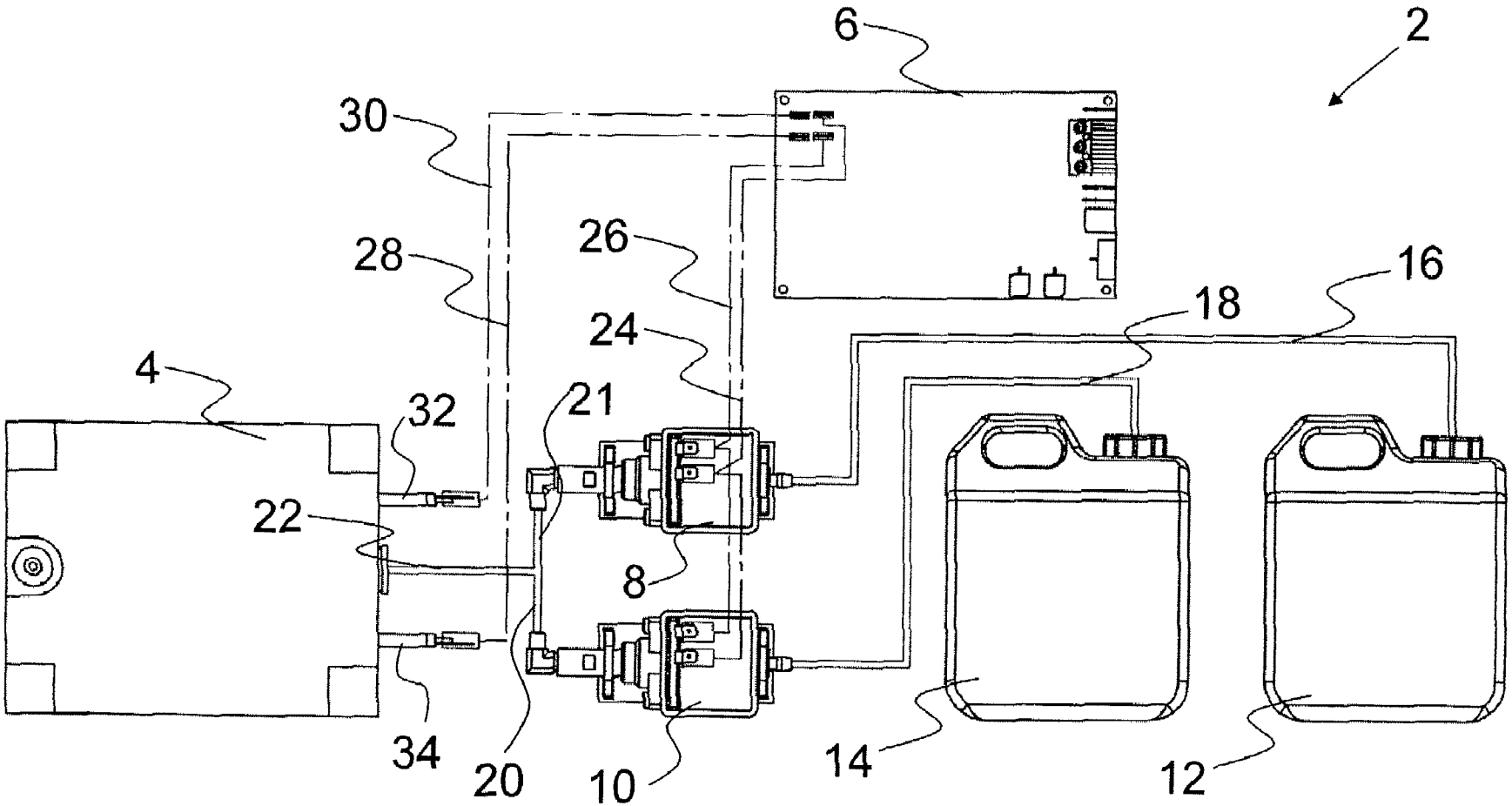
FIG. 1 shows a smoke generating systems.
Figure 2A:
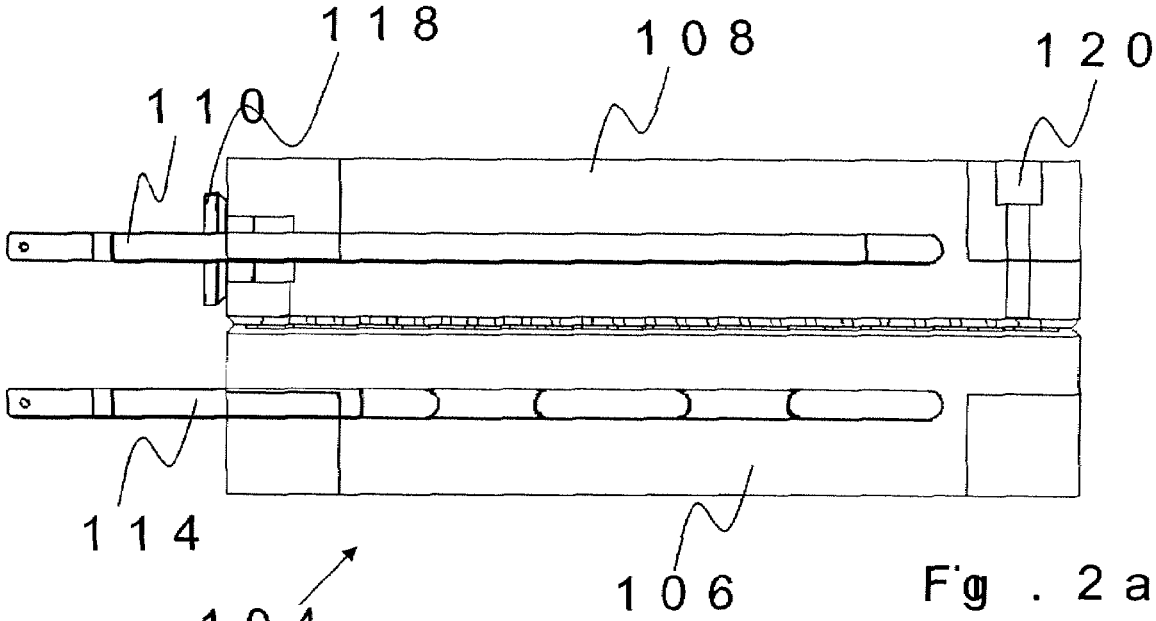
FIGS. 2*a*-2*d* show a first embodiment for a heating storage block.
Figure 2B:
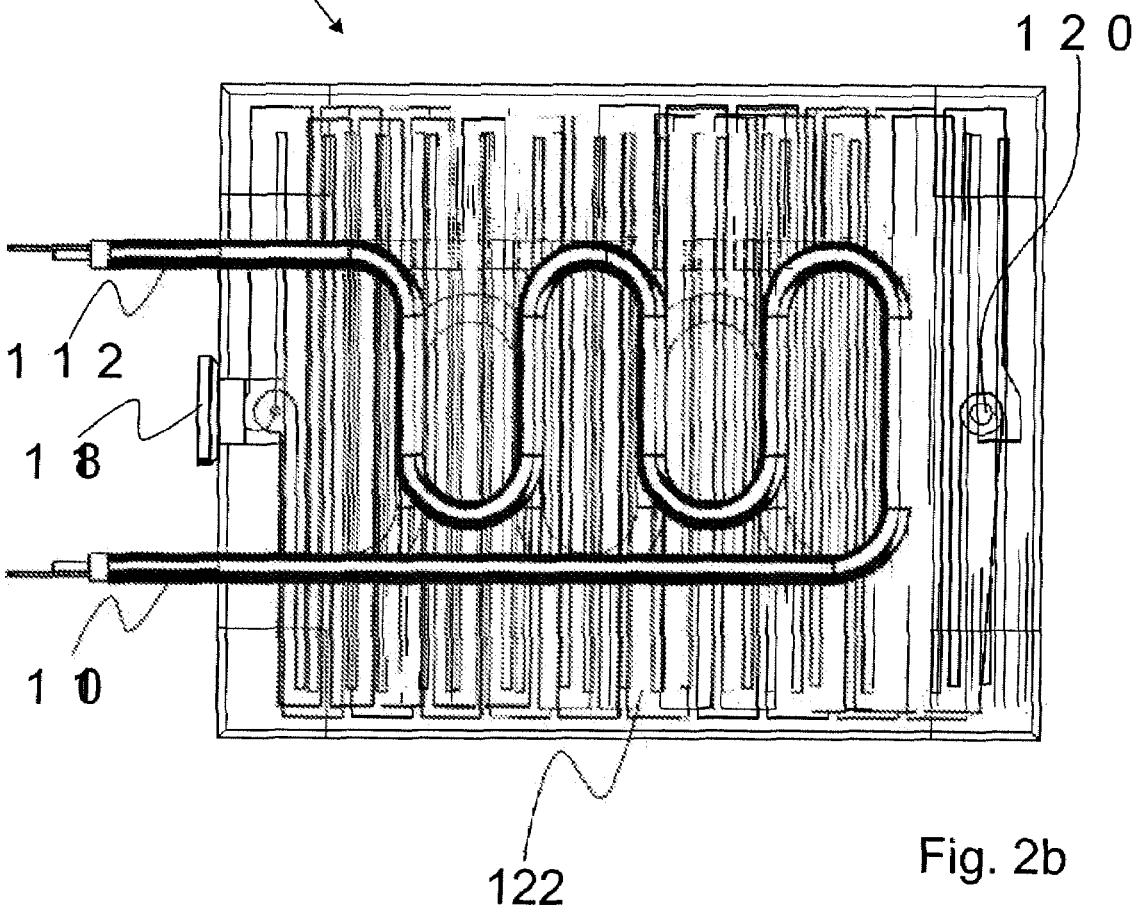
Figure 2C:
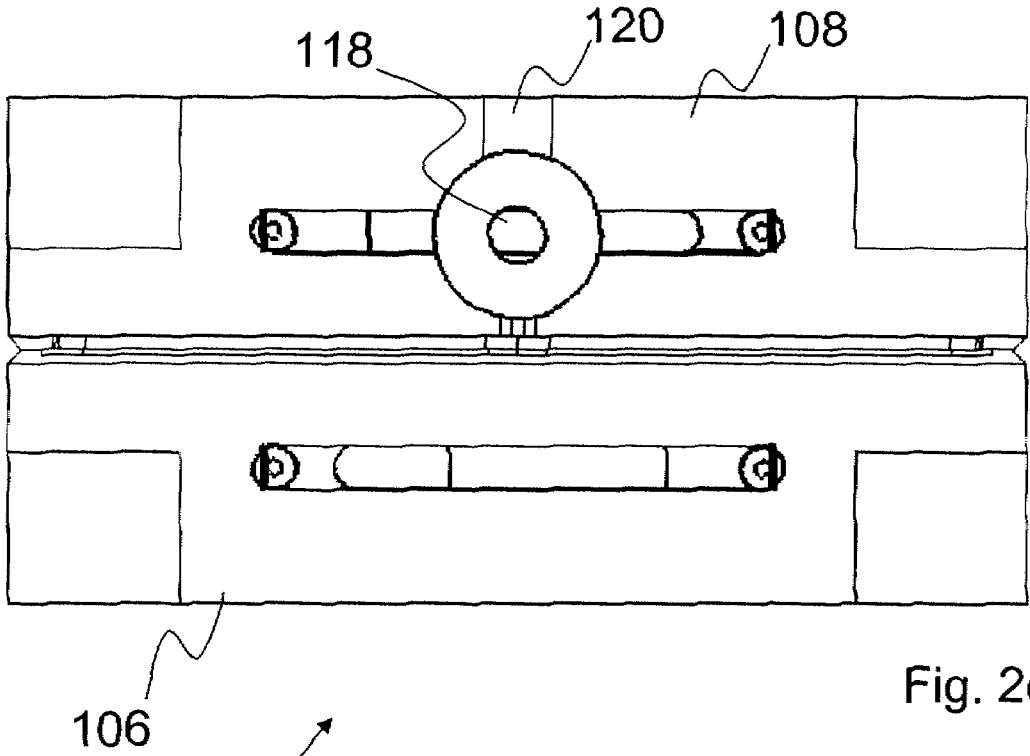
Figure 2D:
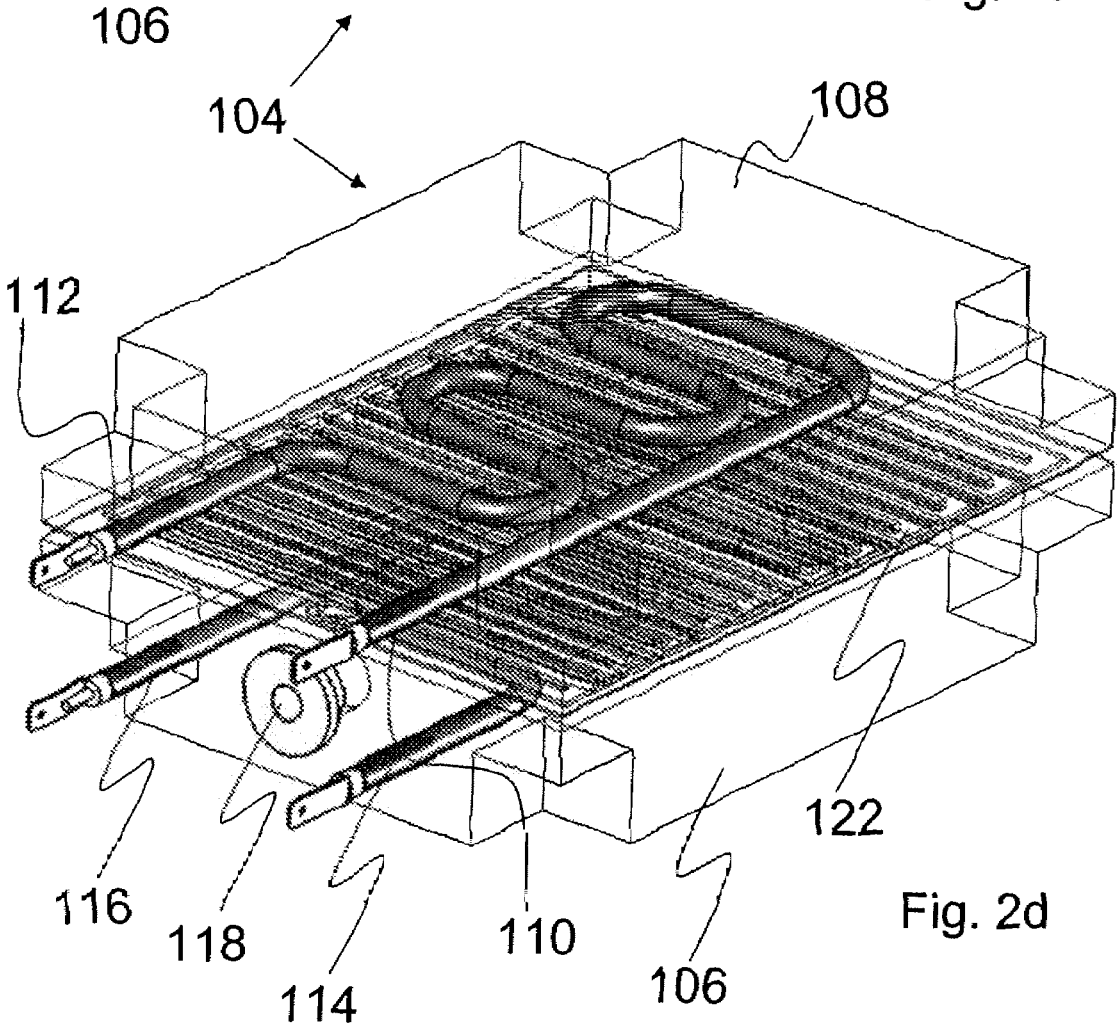

FIG. 1 shows a smoke generating system 2 comprising a heat storage 4 and a printed circuit board 6. The system further comprises a first water pump 8 and a second glycol pump 10. The water is pumped from water storage 12 and the glycol is pumped from glycol storage 14. A water line 16 is connected between the water storage 12 and the first water pump 8. Further, a liquid line 18 connected between the glycol storage 14 and the glycol pump 10. The pump 8 has an outlet 21 and the pump 10 has an outlet 20. The outlets 20 and 21 are combined in a common liquid line 22 which is connected to the heat storage 4. The PCB 6 has a first control line 24 leading towards the pump 10 and a second control line 26 connected to the pump 8. Furthermore, the PCB has electric connections 28 and 30 leading to the heating element placed in the heat storage where this heating element has terminals 32 and 34.

In a first manner of operation, where no intruder is detected, the PCB 6 supplies electrical energy thorough the lines 28 and 30 through the input terminals 32 and 34 to the heating element placed in the heat exchanger. Thereby, the heat storage is heated to a sufficient high temperature for generating smoke. Temperature regulations could be preferred so that the heat exchanger is regulated to a controlled maximum temperature.

If an intruder is detected, and the system is activated the pump 8 and 10 will start operating. These pumps will then pump water and glycol through the lines 16 and 18 and delivering liquids under pressure through the lines 20,21 and 22 to the heat storage 4 where the liquid is evaporated. The evaporated liquid is then sent through an outlet (not shown) into the room that has to be protected. It is to be understood that the power consumption in the heating element placed in the heat storage 4 is relatively limited. Therefore, operation of the heat exchanger can continue even if the lines 28, 30 are not conducting any power towards the heating element through terminal 32, 34. If only the pumps 8, 10 are operating smoke will be generated by the heat stored in the heat storage 4. Thereby, the pumps will able to operate if they are connected by a battery supply or by an uninterruptable power supply.

FIGS. 2*a*-2*d* show heat storage 104 comprising a lower section 106 and an upper section 108. The lower section 106 comprises an electric heating element which comprises terminals 114 and 116. The upper part 108 of the heat storage comprises a second heating element which has inlet terminals 110 and 112. The heating storage 104 comprises and inlet 118 which is connected to a channel 122 which channel is running from the inlet 118 and to the outlet 120.

In operation, liquid is pumped to the inlet 118 into the channel 122 where this liquid will evaporate before it leaves the channel at the outlet 120.

Figure 3:
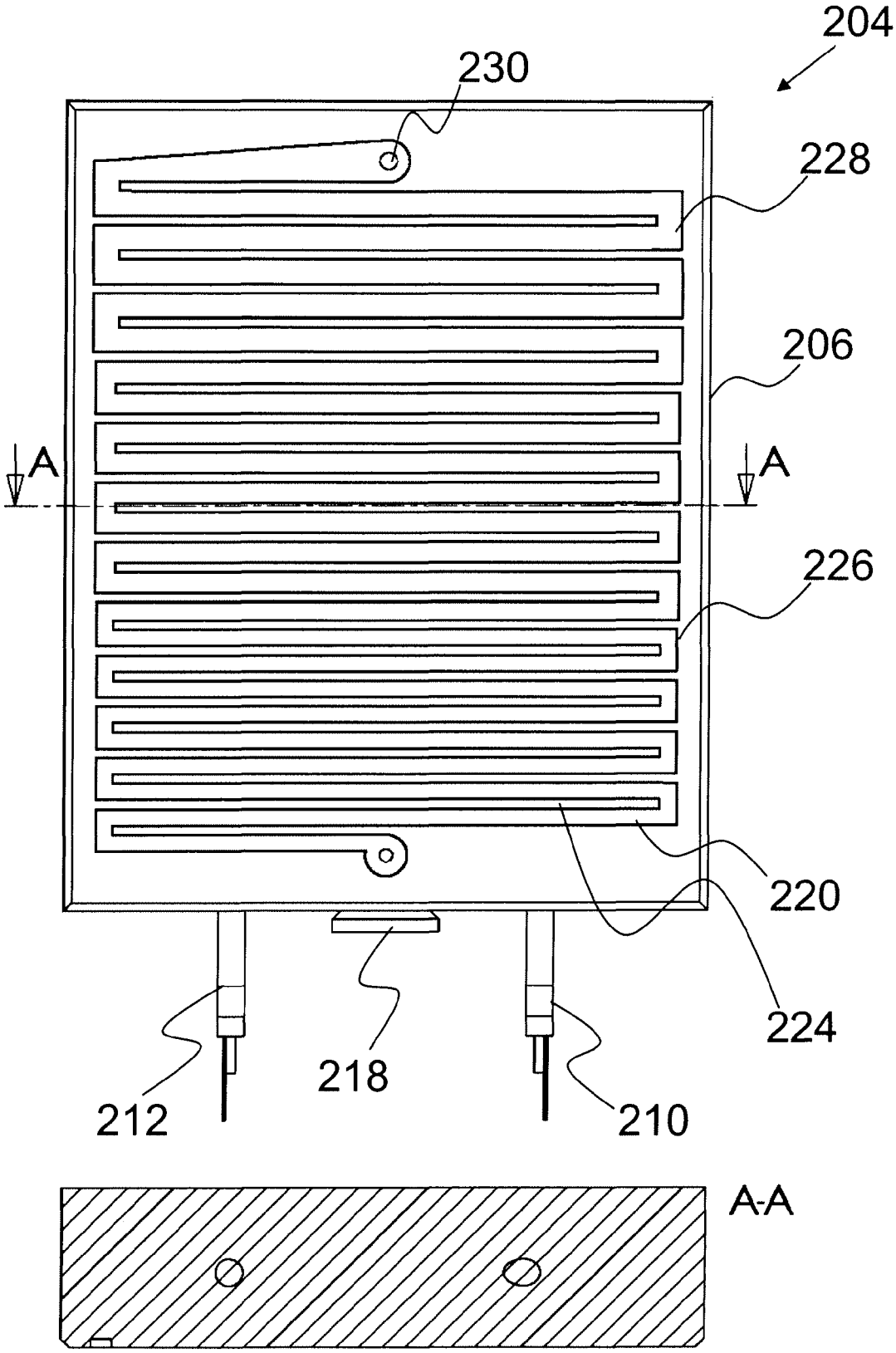
FIG. 3 shows a sectional view of a possible embodiment for a heating block.

FIG. 3 shows the bottom section 204 of a heat storage block as shown at FIG. 2. The lower part of the heat storage block 204 comprises a first terminal 210 and a second terminal 212 connected to a heating element placed in the block 204. The heating block 204 comprises a liquid inlet 218 which is connected to a fluid channel 222. The channel 222 is limited by walls 224 and the channels 220 have edges 226. Towards the outlet the channel 220 is increased into a channel 228, which channel 228 has a bigger cross-sectional area. The channel 228 is connected to an outlet 220.

In operation, the lower section 204 will be covered by the second part of the heating storage block. Fluid is sent through the inlet 208 into the channel 222 in which channel the liquid is heated and the liquid starts boiling and thereby evaporating. Along the channel 222 more and more of the liquid will be converted into steam and at the outlet 220 the liquid contents is supposed to be very small. The liquid is expanding very much by the evaporation, thus the volume of the channel increases over its whole length. This increasing channel cross-sectional area results in a natural reduction of a backflow.

Figure 4A:
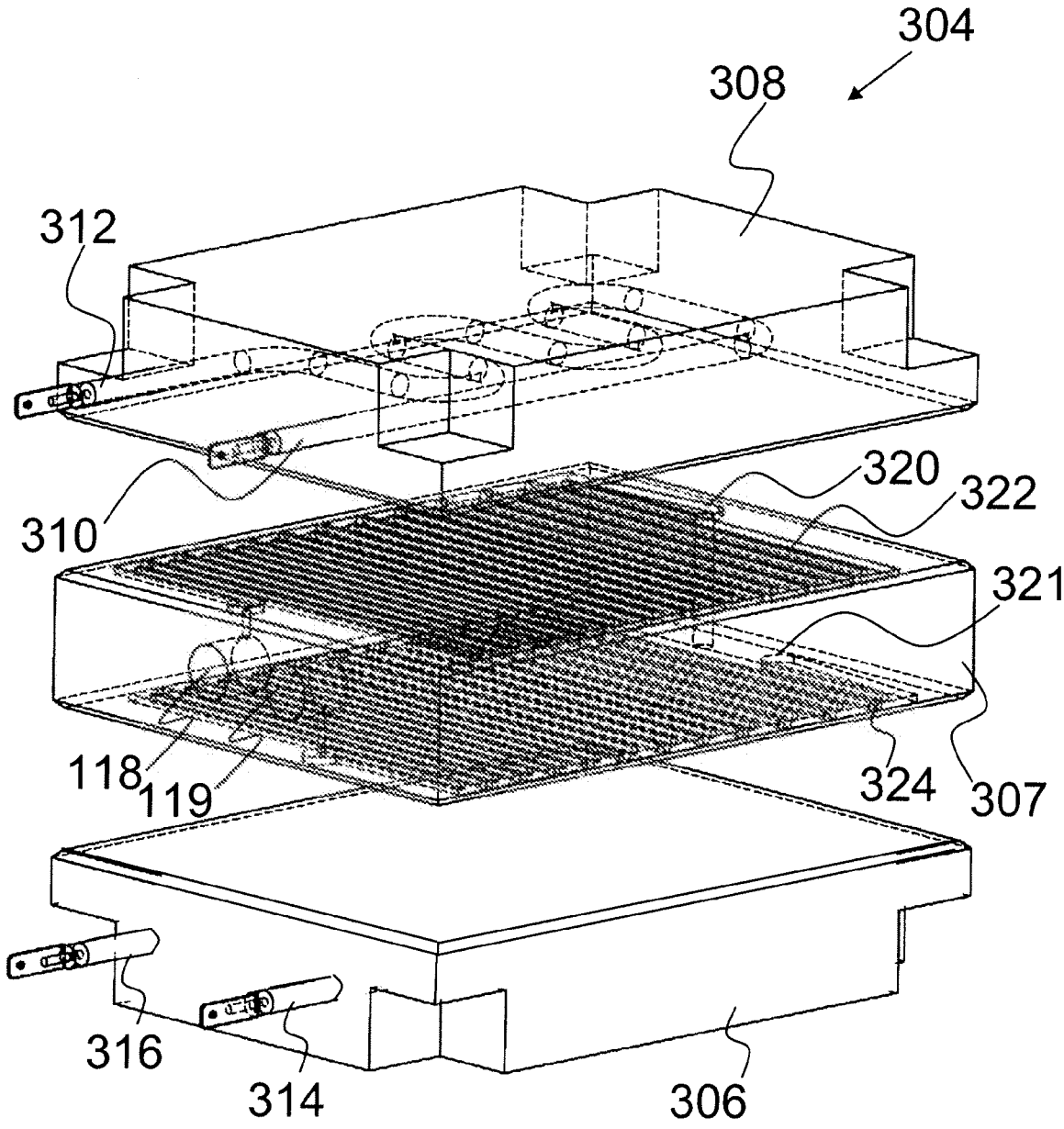
FIGS. 4*a*-4*c* show a second embodiment for the invention.
Figure 4B:
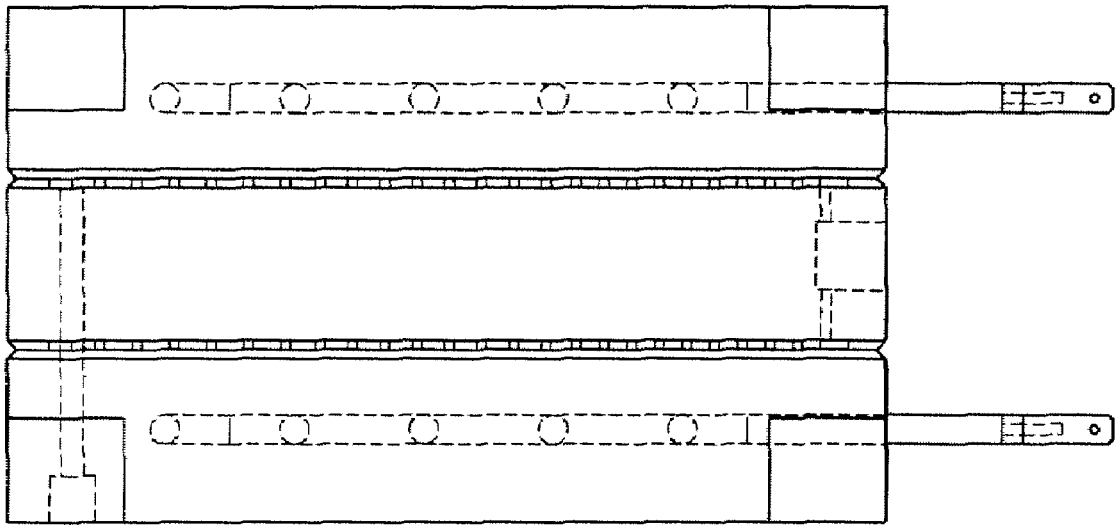
Figure 4C:
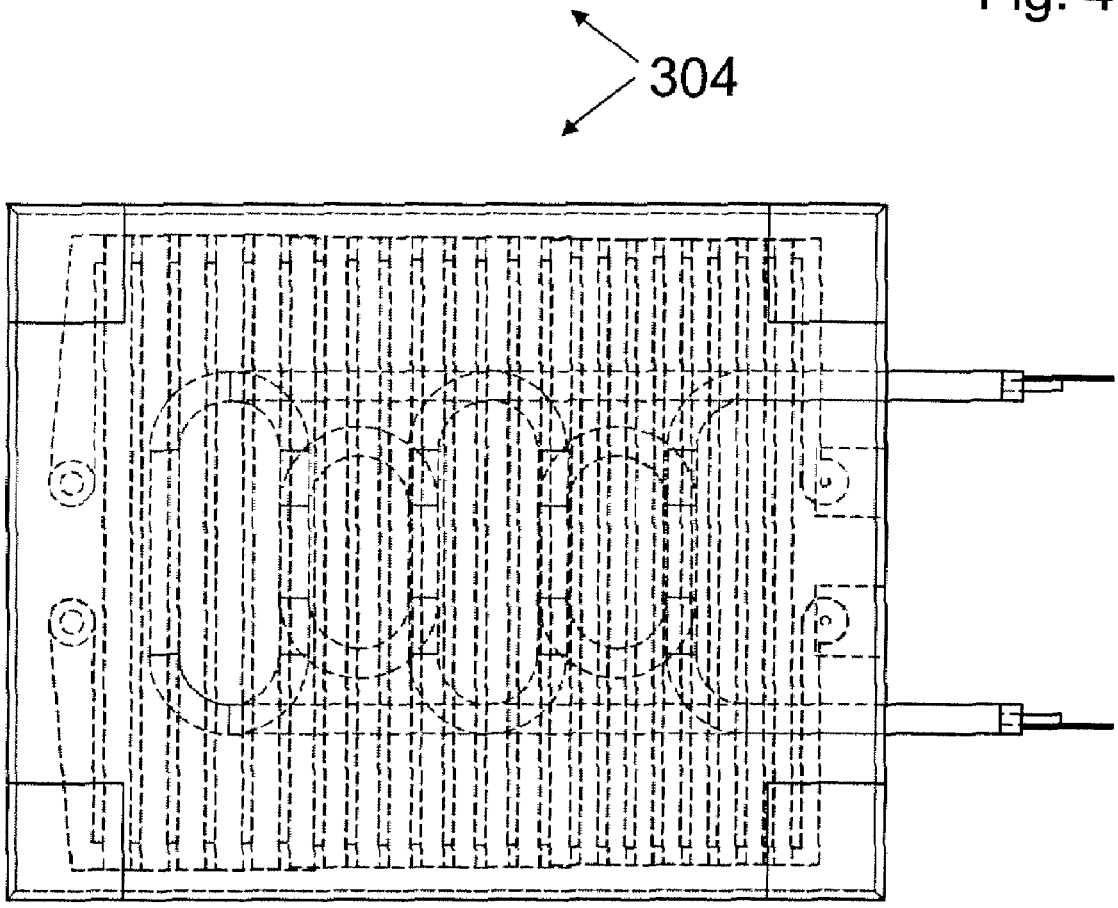

FIGS. 4*a*-4*c* show an alternative embodiment for the invention. FIG. 4*a* shows a heating storage block 304 which comprises an upper section 308 and a lower section 306. Between these two sections are placed a middle section 307. The upper section 308 comprises an electric heating element embedded in the material, which electric heating element has a first terminal 310 and a second terminal 312. Furthermore, the lower part 306 has an electrical heating element embedded in the material and this heating element comprises electrical terminals 314 and 316. The middle section 307 comprises inlets 318 and 319. Furthermore, the middle section comprises channels as well at the upperside as the lower side. These channels has the number 322 and 324. The channels end at an upper outlet 320 and a lower outlet 321.

By using three-layer heat storage, the storage capacity is increased. And because there are two channels formed in the middle section the capacity of smoke generation is increased. Furthermore, the total mass in relation to the previous described embodiments increased. This also means in this embodiment there is sufficient heat stored in the heat storage means 304 to let the smoke generator operate without power supply for a longer period which is supposed to be as high as 40 minutes.

For both embodiments it is important that the heat storage has relatively high heat conductivity in order to conduct heat towards the channels during operation. Therefore, the heating storage is probably produced of metal. One possible metal for this purpose is an aluminium alloy. Other metals or other alloys could be used depending on the heat storage capacity.

What is claimed is:

1. An intruder deterrent system, which system generates a smoke screen and which system comprises: intruder detection means; smoke screen generating means; activating means operatively linked to the intruder detecting means and where the smoke screen generating means activate the smoke screen generating means when the intruder detection means is triggered, wherein the smoke generating means comprises a heating storage, which heating storage comprises at least one first electric heater, which heating storage block comprises at least one flow channel, which flow channel comprises a number of turns, which channel has a length that at least is longer than the longest side of the heating storage.

2. An intruder deterrent system according to claim 1, wherein the heating storage is formed of at least two sections which sections are fastened towards each other by fastening means.

3. An intruder deterrent system according to claim 1, wherein that the heating storage block comprises an upper section and a lower section, which heating block further comprises a middle section, which middle section is placed between the upper section and the lower section, which upper section comprises at least one electric heating element embedded in the material, which electric heating element comprises a first terminal and a second terminal, which lower part further comprises an electrical heating element embedded in the material, which heating element comprises electrical terminals, which middle section comprises inlets, which the middle section comprises channels as well at the upper side as the lower side.

4. An intruder deterrent system according to claim 1, wherein the channel has at least a first inlet connected towards at least a first pump, which channel has at least one outlet connected to a system outlet.

5. An intruder deterrent system according to claim 1, wherein the channel comprises a first cross-sectional area near the inlet is smaller than the cross -sectional area near the outlet.

6. An intruder deterrent system according to claim 5, wherein the channel is formed with a number of turns, which turns is formed with a minimal radius, which turns is formed with a crisp.

7. An intruder deterrent system according to claim 6, wherein the turns of the at least one flow channel are sharp 90 degree angle turns.

8. An intruder deterrent system according to claim 1, wherein the intruder deterrent system comprises at least one pump, the duration of operation of the pump is controllable by said control means to regulate the density of the smoke screen.

9. An intruder deterrent system according to claim 1, wherein the intruder deterrent system comprises a storage tank for an aqueous liquid composition and one or more delivery pipes extending from the tank to deliver the liquid composition to the heat storage, which heat storage comprising heating means to heat the liquid composition in the channel to thereby convert the liquid composition into a dense vapour.

10. An intruder deterrent system according to claim 9, wherein the aqueous liquid composition comprises a mixture of glycol and water.

11. An intruder deterrent system according to the claim 8, wherein that the intruder deterrent system comprises at least one pump , where the rate of operation of the pump is controllable by said control means in dependence upon the temperature of the heat storing block.

12. An intruder deterrent system according to claim 1, wherein the intruder deterrent system comprises a liquid control system, which liquid control system comprises a first liquid container, which liquid control system further comprises a second liquid container, which first liquid container contains a first liquid, which first liquid is mostly water, which second container contains a second liquid, which second liquid is mostly glycol, which liquid control system comprises a first pump for pumping the first liquid, which liquid control system further comprises a second pump for pumping the second liquid.

13. An intruder deterrent system according to claim 1, wherein the intruder deterrent system comprises at least a first density sensor.

14. An intruder deterrent system according to claim 1, wherein the density sensor is housed in a first housing and the smoke screen generating means is housed in another housing independent from the said first housing.

15. An intruder deterrent system according to claim 14, wherein the smoke screen density sensor and the smoke screen generating means are operatively linked by wireless communication means.

16. An intruder deterrent system according to claim 14, wherein a number of intruder deterrent system are operatively linked by wireless communication means, wherein the heating elements are operating in time share mode depending on actual heating demand.

17. An entertainment system, which system generates a smoke screen and which system comprises smoke screen generating means; activating means operatively linked to the an entertainment controller and where the smoke screen generating means activate the smoke screen generating means when the entertainment controller is transmitting a smoke command, wherein the smoke generating means comprises a heating storage, which heating storage comprises at least one first electric heater, which heating storage block comprises at least one flow channel, which flow channel comprises a number of turns, which channel has a length that at least is longer than the longest side of the heating storage.

18. An entertainment system according to claim 17, wherein that the heating storage is formed of at least two sections, which sections are fastened to each other by fastening means.

19. An entertainment system according to claim 18, wherein that the heating storage block comprises an upper section and a lower section, which heating block further comprises a middle section, which middle section is placed between the upper section and the lower section, which upper section comprises at least one electric heating element embedded in the material, which electric heating element comprises a first terminal and a second terminal, which lower part further comprises an electrical heating element embedded in the material, which heating element comprises electrical terminals, which middle section comprises inlets, and wherein said at least one flow channel comprises channels at an upper side and a lower side of the middle section.

20. An entertainment system according to claim 18, wherein said at least one flow channel has at least a first inlet connected to at least a first pump and at least one outlet connected to a system outlet.

21. An entertainment system according to the claim 18, wherein said at least one flow channel has a first cross-sectional area near the inlet that is smaller than a cross-sectional area near the outlet.

22. An entertainment system according to claim 18, wherein said at least one flow channel is formed with a number of turns, which turns are formed with sharp angle having a minimal radius.

23. An entertainment system according to claim 22, wherein the sharp angle having a minimal radius of the turns is a sharp 90 degree angle.

24. An entertainment deterrent system according to claim 18, wherein the entertainment system comprises at least one pump, the duration of operation of the pump being controllable by control means to regulate the density of the smoke screen.

25. An entertainment system according to claim 24, wherein the intruder deterrent system comprises at least one pump, where the rate of operation of the at least one pump is controllable by said control means in dependence upon the temperature of the heat storing block.

26. An entertainment deterrent system according to claim 18, wherein the entertainment system comprises a storage tank for an aqueous liquid composition and one or more delivery pipes extending from the tank to deliver the liquid composition to the heat storage, which heat storage comprises heating means to heat the liquid composition in the at least one flow channel to thereby convert the liquid composition into a dense vapour.

27. An entertainment system according to claim 26, wherein the aqueous liquid composition comprises a mixture of glycol and water.

28. An entertainment system according to claim 18, further comprising an intruder deterrent system having a liquid control system, which liquid control system comprises a first liquid container and a second liquid container, wherein the first liquid container contains a first liquid, which first liquid is mostly water, wherein the second container contains a second liquid, which second liquid is mostly glycol, and wherein the liquid control system comprises a first pump for pumping the first liquid, which liquid control system further comprises a second pump for pumping the second liquid.

29. An entertainment system according to claim 18, wherein the entertainment system comprises at least a first density sensor.

30. An entertainment system according to claim 29, wherein the density sensor is housed in a first housing and the smoke screen generating means is housed in another housing independent from the said first housing.

31. An entertainment system according to claim 30, wherein the smoke screen density sensor and the smoke screen generating means are operatively linked by wireless communication means.

* * * * *